US005572306A

United States Patent [19]

Goto et al.

[11] Patent Number: 5,572,306

[45] Date of Patent: Nov. 5, 1996

[54] IMAGE FORMING APPARATUS CAPABLE OF SETTING FIXING TEMPERATURE CORRESPONDING TO TEMPERATURE RISING STATE OF HEATING MEMBER

[75] Inventors: Masahiro Goto; Takahiro Inoue; Koichi Hiroshima; Koichi Suwa, all of Yokohama; Shinichi Tsukida, Okegawa; Manabu Takano, Machida, all of Japan

[73] Assignee: Canon Kabushiki Kaisha, Tokyo, Japan

[21] Appl. No.: 480,326

[22] Filed: Jun. 7, 1995

Related U.S. Application Data

[63] Continuation of Ser. No. 789,893, Nov. 12, 1991, abandoned.

[30] Foreign Application Priority Data

Nov. 13, 1990 [JP] Japan ..... 2-307912

[51] Int. Cl.[6] ..... G03G 15/20

[52] U.S. Cl. ..... 399/69; 219/216

[58] Field of Search ..... 355/205, 204, 355/208, 282, 285, 284; 219/216, 469–471

[56] References Cited

U.S. PATENT DOCUMENTS

| | | | |
|---|---|---|---|
| 4,652,110 | 3/1987 | Sato et al. . | |
| 4,883,715 | 11/1989 | Kuge et al. . | |
| 4,920,250 | 4/1990 | Urban | 355/285 X |
| 5,053,806 | 10/1991 | Haigo et al. | 355/285 X |
| 5,179,263 | 1/1993 | Koh et al. | 219/216 |

FOREIGN PATENT DOCUMENTS

| | | | |
|---|---|---|---|
| 0222120 | 5/1987 | European Pat. Off. . | |
| 0373654 | 6/1990 | European Pat. Off. . | |
| 0390168 | 10/1990 | European Pat. Off. . | |
| 0432687 | 6/1991 | European Pat. Off. . | |
| 60-41354 | 9/1985 | Japan . | |
| 61-290465 | 12/1986 | Japan . | |
| 63-81379 | 4/1988 | Japan | 355/204 |
| 63-178281 | 7/1988 | Japan . | |
| 63-178280 | 7/1988 | Japan . | |
| 63-291067 | 11/1988 | Japan . | |
| 2-006275 | 3/1990 | Japan . | |
| 2-163787 | 6/1990 | Japan . | |
| 2-178687 | 7/1990 | Japan . | |
| 2-207286 | 8/1990 | Japan . | |
| 3-171080 | 7/1991 | Japan . | |
| 3-163483 | 7/1991 | Japan . | |
| 3-209492 | 9/1991 | Japan . | |
| 5-080863 | 4/1993 | Japan . | |

*Primary Examiner*—Arthur T. Grimley
*Assistant Examiner*—Shuk Yin Lee
*Attorney, Agent, or Firm*—Fitzpatrick, Cella, Harper & Scinto

[57] ABSTRACT

An image forming apparatus for forming an image on a recording medium, having an image bearing member; an image forming device for forming an image on the image bearing member; a transfer device for transferring the image formed on the image bearing member by the image forming device onto a recording medium; a heat fixing unit for fixing the image transferred to the recording medium by the transfer device onto the recording medium; a power source; and a controller for detecting a temperature increased condition of the heat fixing unit when the power source is turned ON and for determining a temperature adjust temperature of the heat fixing unit at a fixing operation in accordance with the detected result.

15 Claims, 5 Drawing Sheets

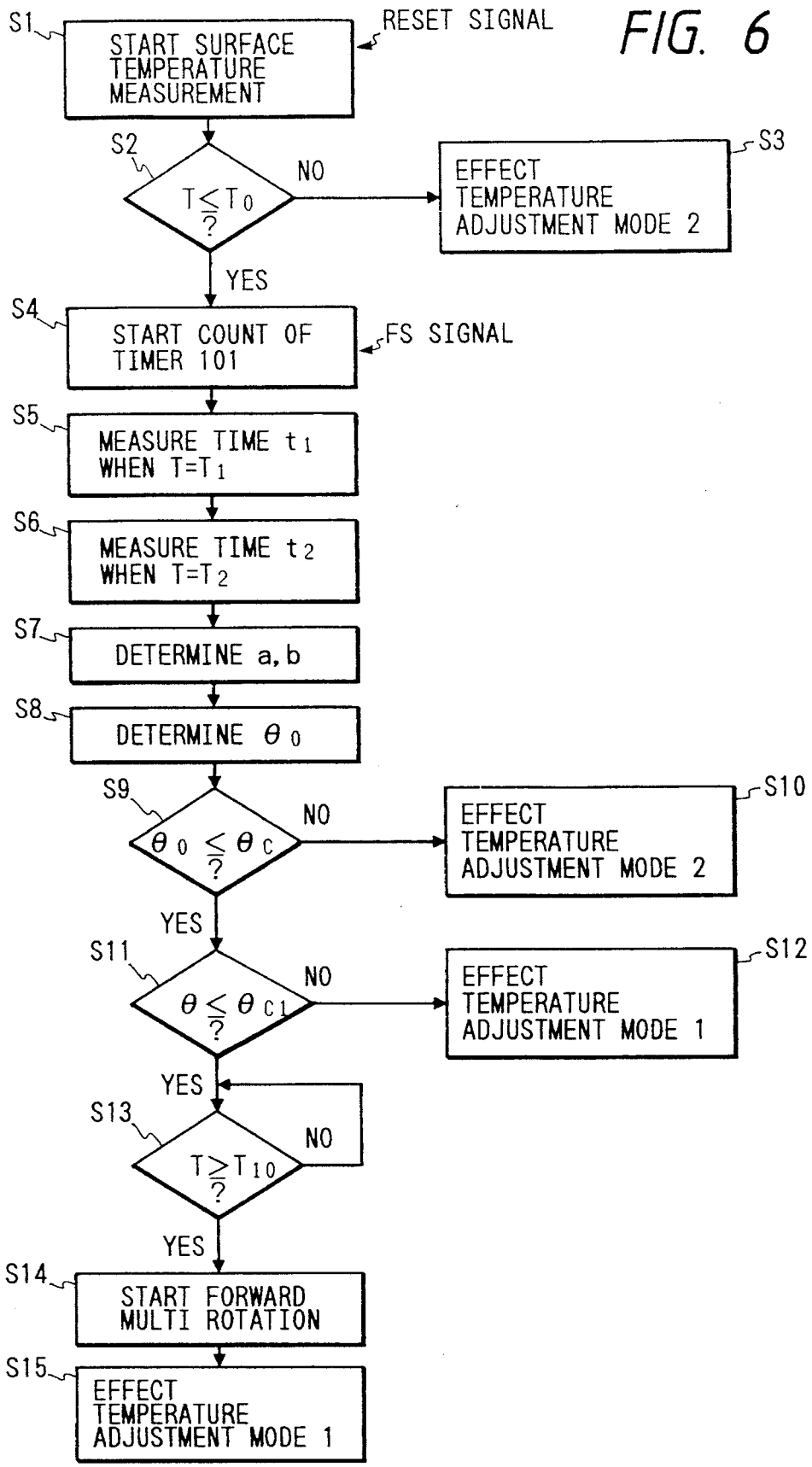
FIG. 6
S1
START SURFACE TEMPERATURE MEASUREMENT
RESET SIGNAL
S2
T ≤ T0 ?
NO
S3
EFFECT TEMPERATURE ADJUSTMENT MODE 2
YES
S4
START COUNT OF TIMER 101
FS SIGNAL
S5
MEASURE TIME t1 WHEN T=T1
S6
MEASURE TIME t2 WHEN T=T2
S7
DETERMINE a, b
S8
DETERMINE θ0
S9
θ0 ≤ θc ?
NO
S10
EFFECT TEMPERATURE ADJUSTMENT MODE 2
YES
S11
θ ≤ θc1 ?
NO
S12
EFFECT TEMPERATURE ADJUSTMENT MODE 1
YES
S13
T ≥ T10 ?
NO
YES
S14
START FORWARD MULTI ROTATION
S15
EFFECT TEMPERATURE ADJUSTMENT MODE 1

IMAGE FORMING APPARATUS CAPABLE OF SETTING FIXING TEMPERATURE CORRESPONDING TO TEMPERATURE RISING STATE OF HEATING MEMBER

This application is a continuation of application Ser. No. 07/789,893, filed Nov. 12, 1991, now abandoned.

BACKGROUND OF THE INVENTION

1. Field of the Invention

The present invention relates to image forming method and apparatus for forming an image on a recording medium.

2. Related Background Art

A heat roller fixing device has widely been used with an image forming apparatus such as an electrophotographic printer and the like because it has high thermal efficiency and high safety. In such a fixing device, a surface temperature of a heat roller, a pressure between the heat roller and a pressure roller, and a width of a nip constitute important factors for determining the fixing ability of a toner image on a recording medium, the curling amount of the recording medium, and the temperature increase in the image forming apparatus. Now, the fixing ability and the curling amount have the contradictory tendency that when one of them is improved the other will be worsened. More specifically, in order to improve the fixing ability, it is preferable to increase the surface temperature of the heat roller and/or to increase the nip pressure and the nip width; however, by doing so the curling amount and the temperature in the apparatus will be increased (worsened). Among them, the increase in the surface temperature of the heat roller has the greatest detrimental effect upon the curling amount.

Further, the image forming apparatus has been made smaller and inexpensive, and a thickness and an outer diameter of the heat roller have been decreased. Recently, a heat roller having a diameter of 30 mm or less has been used. However, when the thickness of the heat roller is decreased or when the diameter of the heat roller is decreased, in order to increase the fixing ability of the toner image, it is more difficult to increase the nip width or nip pressure; thus, it is preferable to increase the surface temperature of the heat roller.

Consequently, as mentioned above, the curling amount of the recording medium and the temperature in the apparatus will be increased.

To avoid this, it is preferable to adjust the surface temperature in accordance with the atmospheric temperature during the fixing operation in order to give the minimum necessary heat quality to the recording medium, as disclosed in the Japanese Patent Publication No. 60-41354 (filed on Aug. 24, 1978, published on Sep. 17, 1985). Particularly, it is known that the fixing ability is greatly influenced upon the temperature of the recording medium and the surface temperature of the pressure roller. The temperature of the recording medium is governed by the atmospheric temperature, and the surface temperature of the pressure roller depends upon the time period elapsed from the initiation of energization of the image forming apparatus. Thus, in most cases, a temperature adjustment mode wherein the control of the surface temperature of the heat roller is changed on the basis of the detection of the atmospheric temperature includes the detection of the atmospheric temperature at the initiation of energization of the image forming apparatus. If the atmospheric temperature is lower than a predetermined temperature, the surface temperature of the heat roller is set to a value slightly higher than the normal value, and then, when the pressure roller is sufficiently warmed, the normal temperature adjustment mode is restored.

However, when the surface temperature is changed on the basis of the atmospheric temperature in this way, it is necessary to provide a special temperature detecting element for detecting the atmospheric temperature.

For example, in order to detect the atmospheric temperature, a temperature detecting element (for example, thermistor) for detecting the atmospheric temperature is arranged in place within the image forming apparatus, and the surface temperature of the heat roller of the heat roller fixing device is controlled on the basis of the detected temperature. In many cases, the temperature detecting element is disposed on a control board for controlling the operation of the image forming apparatus to eliminate the complexity of the wiring within the apparatus. However, since the temperature detecting element for detecting the atmospheric temperature is additionally provided, the apparatus becomes more expensive.

Further, in many cases, since the control board is disposed remote from the heat roller fixing device, the temperature detecting element does not correctly monitor the atmospheric temperature (including the temperature of the pressure roller) in the proximity of the heat roller fixing device. Thus, despite the pressure roller having been warmed adequately, if the atmospheric temperature in the proximity of the control board is low, the temperature detecting element for detecting the atmospheric temperature will judge or determine that the atmospheric temperature is low, with the result that the surface temperature of the heat roller is controlled to have a value higher than the normal value. This is unsuitable, particularly in an electrophotographic printer wherein a power source switch is frequently switched between an ON condition and an OFF condition to perform the switching of a print modes and the replacement of a photo-cartridge.

SUMMARY OF THE INVENTION

An object of the present invention is to provide an image forming method and an image forming apparatus which can eliminate the above-mentioned conventional drawback and can form an image with high quality.

Another object of the present invention is to provide an image forming method and an image forming apparatus which can improve the fixing ability for an image.

A further object of the present invention is to provide an image forming method and an image forming apparatus wherein a recording medium is hard to be curled.

A still further object of the present invention is to provide an image forming method and an image forming apparatus which can suppress the increase in temperature within the apparatus to the minimum extent.

The other object of the present invention is to provide an image forming method and an image forming apparatus wherein, when a visualized image on the recording medium is thermally fixed, a heated condition of a heating member is detected at an initial condition after a main power source switch is turned ON, and a temperature of the heating member is determined and adjusted on the basis of the detected result.

BRIEF DESCRIPTION OF THE DRAWINGS

FIG. 6 is a flow chart according to another embodiment of the present invention.

DETAILED DESCRIPTION OF THE PREFERRED EMBODIMENTS

The present invention will now be explained in relation to an example of an image forming apparatus such as an electrophotographic printer, particularly having a fixing means for fixing a visualized image on a recording medium by heat.

Figure 7:
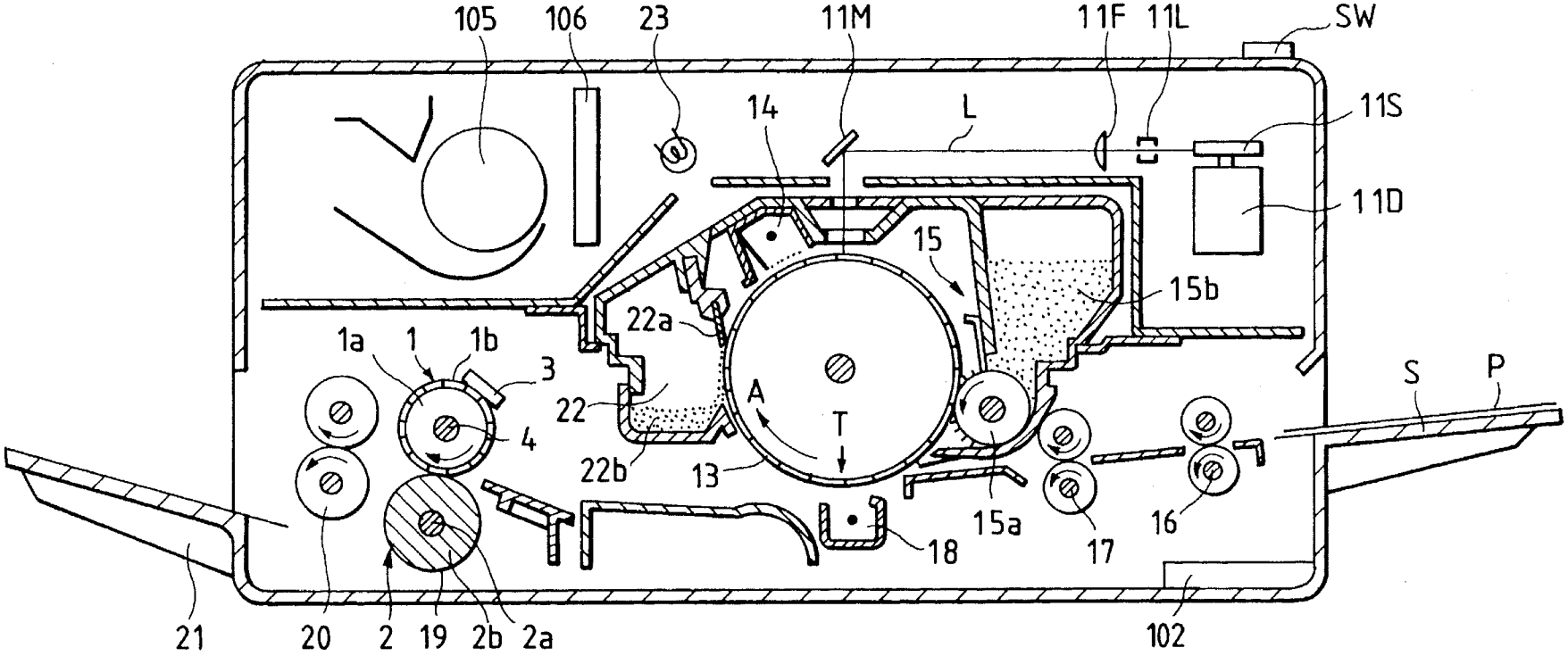
FIG. 7 is an elevational sectional view of an image forming apparatus according to a preferred embodiment of the present invention.

FIG. 7 is an elevational sectional view of an electrophotographic printer of laser exposure type which is an image forming apparatus according to a preferred embodiment of the present invention.

In FIG. 7, a semi-conductor laser 11L acts as a laser emitting element turned ON/OFF in response to image information from a computer, word processor, facsimile and the like. The laser beam L corresponding to the image information and emitted from the semi-conductor laser reaches on a polygonal mirror 11S rotatingly driven by a motor 11D and is scanned and deflected by the rotation of this polygonal mirror 11S.

The laser beam L passes through a focusing lens 11F such as an f-θ lens and then is reflected by a mirror 11M to be focused as a spot on an electrophotographic photosensitive drum (photosensitive member) 13 rotated in a direction shown by the arrow A. Thus, the laser beam scans the drum 13 repeatedly along a direction perpendicular to the rotational direction A.

A charger 14 serves to charge the photosensitive drum 13 uniformly. The photosensitive drum 13 charged by the charger 14 is scanned by the laser beam L modulated in correspondence to the image information, so that an electrostatic latent image is formed on the drum. In the illustrated embodiment, a so-called image scan system wherein a portion of the photosensitive drum 13 to which toner is to be adhered (i.e., on which a visualized image is to be formed) is illuminated by the laser beam and the charge given to that portion of the drum surface by the charge 14 is removed therefrom.

The electrostatic latent image is visualized with toner by a developing device 15. The toner is charged with polarity such that the toner can be adhered to an area of the photosensitive drum 13 illuminated by the laser beam L (i.e., a bright potential area). Incidentally, the reference numeral **15*a* denotes a developing sleeve; 15*b*** denotes a toner containing portion.

On the other hand, a transfer sheet P rested on a stacking plate S is supplied to a transfer position T by a pair of supply rollers 16 and a pair of regist rollers 17 which are rotated in timed relation that a toner image on the photosensitive drum 13 are registered with the sheet P at the transfer position T. Then, the toner image on the photosensitive drum 13 is transferred onto the sheet P by means of a transfer charger 18. After the sheet P separated from the drum 13, the sheet is fed to a fixing device 19 where the toner image is fixed to the sheet P. Thereafter, the sheet is ejected on a tray 21 by means of a pair of ejector rollers 20.

On the other hand, after the toner image is transferred from the drum to the sheet, the residual toner remaining on the drum 13 is removed from the drum by means of a cleaner 22. Incidentally, the reference numeral **22*a* denotes a cleaning blade; 22*b* denotes a waste toner reservoir. Then, the drum is uniformly illuminated by a pre-exposure light source 23. By illuminating the drum by the light source 23**, the charges on the drum are removed, thus preparing for the next usage.

Next, the fixing device 19 will be explained.

In the fixing device, a heat roller 1 comprises a metal core la made of aluminium, iron, Sus or the like, and a separating agent layer **1*b* made of fluororesin such as 4-fluoroetylene, 4-fluoroetyleneperfluoroalkoxietylene copolymer or the like and formed on the metal core. A halogen heater 4 is disposed within the heat roller to heat the metal core 1*a* and the separating agent layer 1*b*. A surface temperature of the heat roller 1 is detected by a thermistor 3, and a detection signal from the thermistor is inputted to a CPU 6 via an A/D converter 5. The CPU 6 performs the ON/OFF control of the halogen heater 4 on the basis of the received detection signal via an AC driver 7 to maintain the surface temperature of the heat roller 1 to a predetermined value. A pressure roller 2 of the fixing device comprises a metal core 2*a*** made of iron, Sus or the like, and a coating layer made of silicone rubber, silicone sponge or the like, and cooperates with the heat roller so that the recording medium (transfer sheet) can be contacted with the heat roller with a predetermined nip width and nip pressure.

Incidentally, a control portion 100 for performing the control of the whole image forming apparatus is disposed within the image forming apparatus. The control portion 100 comprises, for example, the above-mentioned CPU 6 such as a microprocessor, a ROM 103 for storing a control program shown as a flow chart in FIG. 2 and executed by the CPU 6 and various data, a RAM 104 used as a work area for the CPU 6 and adapted to temporarily store various data, and a timer 101 as will be described later.

Figure 2:
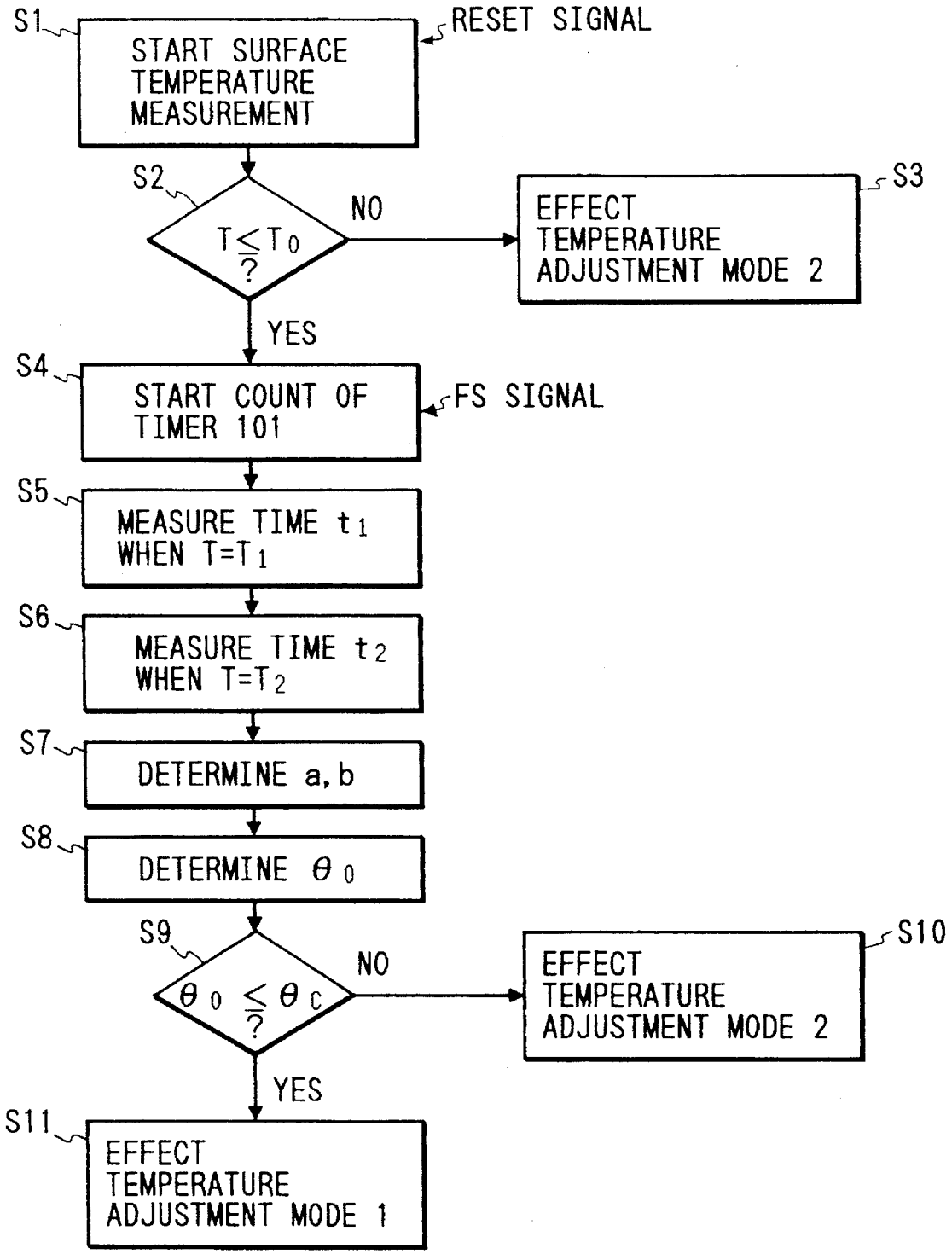
FIG. 2 is a flow chart according to a preferred embodiment of the present invention.

FIG. 2 shows a flow chart for explaining a control method for controlling the surface temperature of the heat roller in the illustrated embodiment.

When a main switch SW of the image forming apparatus according to the illustrated embodiment is turned ON, a main power source is energized to send a reset signal to the CPU 6, thus starting the measurement of the surface temperature of the heat roller 1 (Step S1).

In a step S2, a measured surface temperature T of the heat roller 1 is compared with a predetermined temperature $T_0$. If the temperature T is greater than the temperature $T_0$, it is judged that the heat roller fixing device 19 is warmed adequately, thus immediately effecting a temperature adjustment mode 2 to bring the surface temperature to a normal temperature adjust temperature Tn (step S3).

Now, a temperature adjustment mode 1 is a temperature adjustment mode which is effected when it is judged that the surface temperature of the heat roller 1 at the initiation of the energization of the main power source 102 (referred to as "initial temperature of the heat roller" hereinafter) is lower than a predetermined temperature θ. In this mode, after the surface temperature of the heat roller 1 is temperature-adjusted with a temperature Th higher than the normal temperature adjust temperature Tn for a predetermined time, it is temperature-adjusted with the temperature Tn.

When the surface temperature of the heat roller 1 is lower than the temperature $T_0$, the thermistor 3 cannot detect the surface temperature of the heat roller correctly due to its inherent feature (the reason will be described later). Thus, a mode for detecting the initial temperature of the heat roller 1 is effected.

First of all, when an FS signal for commanding the ON state of the halogen heater 4 is emitted from the CPU 6, the timer 101 in the CPU 6 starts to count (step S4). Then, a time $t_1$ when the surface temperature of the heat roller 1 reaches a first predetermined temperature $T_1$ is sought (step S5). Then, a time $t_2$ when the surface temperature reaches a second temperature $T_2$ higher than the first temperature $T_1$ is sought (step S6).

From the obtained data, a calculation or operation is effected (step S7) to seek an equation regarding an approximated linear line T=at+b, thus obtaining an inclination a of the linear line and an armature b:

$$a=(T_2-T_1)/(t_2-t_1),\ b=(t_2T_1-t_1T_2)/(t_2-t_1).$$

Then, by inputting the inclination a and the armature b obtained in the step S7 to a correction expression A·a+b+B previously sought from the measured data regarding the delay in heat response of the thermistor 3, the initial temperature $\theta_0$ of the heat roller 1 is determined (step S8). Where, A and B are constants obtained by experimentally measuring the delay in heat response of the thermistor 3.

Then, the temperature $\theta_0$ so obtained is compared with a temperature θc previously sought (step S9). If the temperature $\theta_0$ is greater than the temperature θc, the temperature adjustment mode 2 is effected (step S10). To the contrary, if the temperature $\theta_0$ is smaller than the temperature θc, the temperature adjustment mode 1 is effected (step S11).

By executing the algorithm as mentioned above, it is possible to detect the initial temperature of the heat roller 1 at the initiation of energization of the image forming apparatus only by the thermistor 3 for detecting the surface temperature of the heat roller 1. This substantially means that it is possible to adjust the temperature in accordance with the atmospheric temperature in the proximity of the heat roller fixing device including the pressure roller.

Next, the technical effect of the illustrated embodiment will be fully described.

Figure 3:
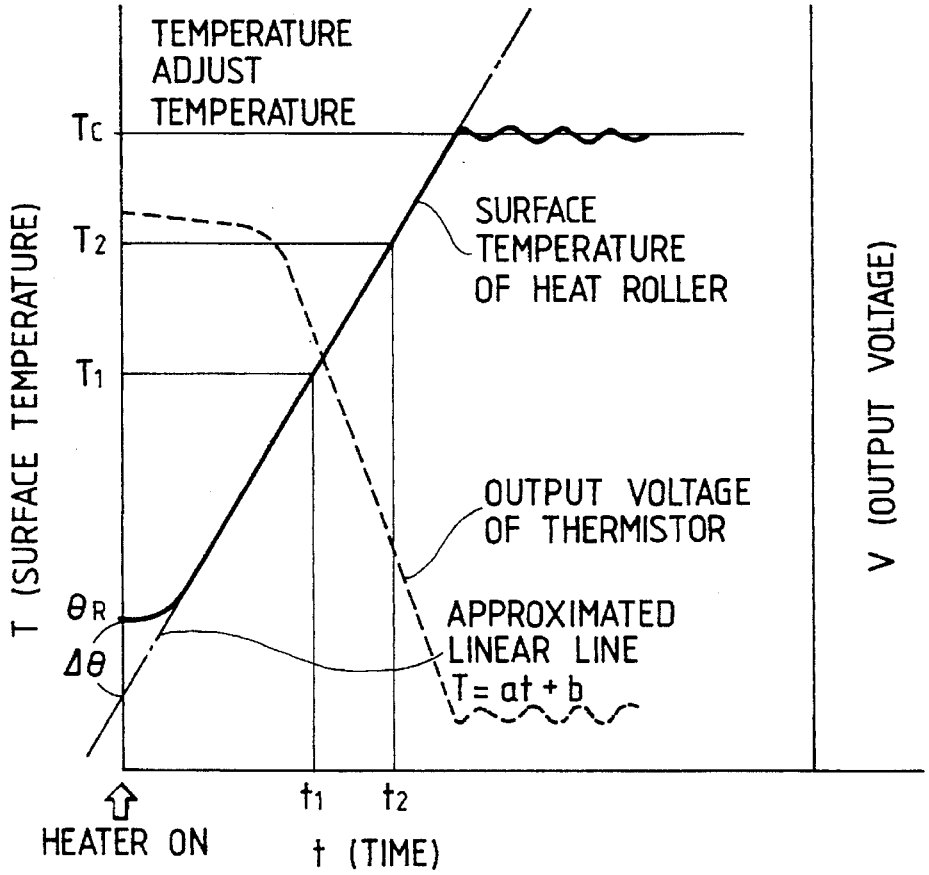
FIG. 3 is a graph showing a relation between a surface temperature of a heat roller and an output voltage of a thermistor.

FIG. 3 is a graph showing a relation between a curve of the surface temperature of the heat roller 1 and a curve of the output voltage of the thermistor 3.

Figure 4:
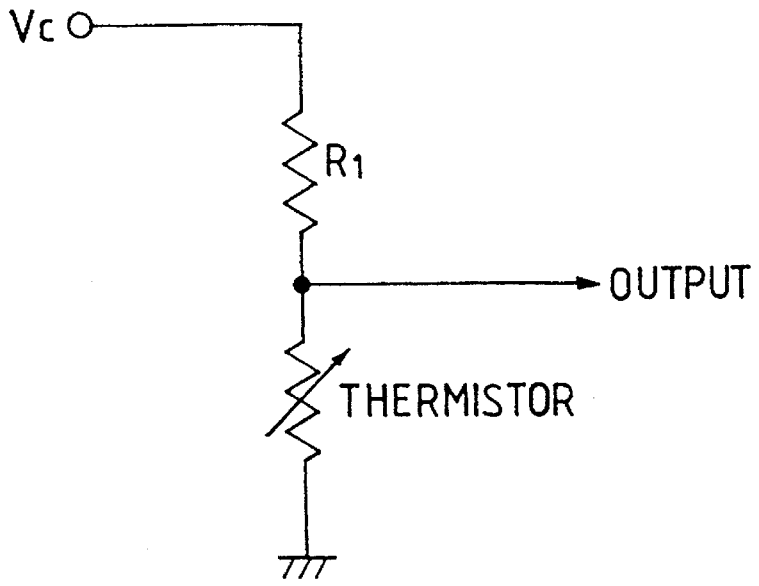
FIG. 4 is a temperature detecting circuit including the thermistor.

The curve of the surface temperature of the heat roller 1 shown by the solid line in FIG. 3 is obtained by measuring the heat roller by means of a conventional thermocouple. As seen in FIG. 3, the surface temperature of the heat roller is increased slowly for a short time from when the halogen heater 4 is turned ON and thereafter is increased abruptly in a linear manner. On the other hand, the curve of the output voltage of the thermistor 3 does not substantially respond to the change in the surface temperature of the heat roller 1 in the proximity of the room temperature, but is changed abruptly in response to the change in the surface temperature of the heat roller 1 in the higher temperature area. The reasons are that, since the resistance value due to the change in temperature of the thermistor 3 (the output voltage of which is obtained by a circuit as shown in FIG. 4) is changed not in the linear manner but in the exponential function manner, the sensibility of the thermistor cannot be high within a wide temperature range, and that the value of the resistor $R_1$ is set so as to obtain the highest sensibility of the thermistor within the temperature range where the surface temperature of the heat roller 1 is desired to be controlled actually. Due to such feature of the thermistor, it is impossible to directly monitor the surface temperature of the heat roller 1 within the low temperature range by the thermistor 3. Thus, in the illustrated embodiment, the surface temperature of the heat roller 1 at the initiation of energization of the apparatus is sought by the use of the temperature range where the sensibility of the thermistor 3 is good and the surface temperature of the heat roller 1 is increased substantially in the linear manner.

Next, a method for detecting the initial temperature of the heat roller 1 will be explained.

By selecting a plurality of points on the curve of the surface temperature of the heat roller 1 and by measuring the temperatue at such points and corresponding time periods from when the halogen heater 4 is turned ON, an approximated linear line is obtained. More particularly, in the illustrated embodiment, times $t_1$ and $t_2$ when the surface temperature of the heat roller reaches predetermined temperatures $T_1$ and $T_2$, respectively, are measured. In this way, in the case where the curve of the surface temperature of the heat roller has the regular linear line, it is sufficient to obtain the data reading at least two points, but, the more the number of data the more correct the approximated linear line to be obtained.

Further, the temperatures to be measured may be selected within the temperature range where the ratio of the change in the output voltage of the thermistor 3 is great. For example, when the temperature adjust temperature of the heat roller 1 is Tc, the temperatures to be measured may be selected within a range of 0.5 Tc–0.9 Tc.

In this way, the equation regarding the approximated linear line will be obtained:

$$T=at+b \qquad \text{(i)}$$

where, T is the surface temperature of the heat roller 1, a is the inclination of the linear line (in the illustrated embodiment, $a=(T_2-T_1)/(t_2-t_1)$), t is a time elapsed from when the halogen heater 4 is turned ON, and b is the armature (in the illustrated embodiment, $b=(t_2T_1-t_1T_2)/(t_2-t_1)$).

The initial temperature θ of the heat roller 1 at the initiation of energization thereof are sought from a correction expression (ii) (shown below) using the inclination a and armature b obtained from the equation (i) and constants A, B determined in accordance with the feature of the thermistor 3:

$$\theta=A\cdot a+B+b \qquad \text{(ii)}$$

The correction expression is used for seeking a difference Δθ (see FIG. 3) between the armature b of the approximated linear line T=at+b and the actual temperature $\theta_R$. Now, the constant A indicates the delay in the heat response of the thermistor 3, and the constant B indicates a term including the rising of the heater, amount of heat escaped from the thermistor 3 and the like. Since these constants are determined not only by the time constant of the thermistor 3 alone but also by actually using the thermistor 3 in abutment against the heat roller 1, the constants A, B may be determined experimentally by using the heat roller fixing device incorporated into the actual image forming apparatus. By using the constants A, B so obtained, from the correction expression (ii), the initial temperature $\theta_0$ of the heat roller at the initiation of energization thereof can be sought.

When the image forming apparatus is not energized for a long time, the initial temperature $\theta_0$ so obtained equals to the atmospheric temperature around the image forming apparatus. Thus, by detecting the initial temperature $\theta_0$ of the heat roller at the initiation of energization thereof, it is possible to detect the atmospheric temperature. Further, when the image forming apparatus is once disenergized and then is re-energized soon, since the surface temperature of the heat roller is height at the initiation of energization, the normal temperature adjustment mode is executed. In this case, since the pressure roller has already been warmed regardless of the atmospheric temperature, the adequate fixing ability can be obtained by the normal temperature adjustment mode. Further, in the small-sized electrophotographic printer, both of the heat roller and the pressure roller have diameters of 30 mm or less and low heat capacities. Accordingly, when disenergized or turned OFF, the surface temperature of the heat roller 1 is decreased quickly, and at the same time the surface temperature of the pressure roller is also decreased quickly. Thus, except for the short time period immediately after the apparatus is energized, in most cases, the surface temperature of the pressure roller 2 can be known approximately.

Next, the illustrated embodiment will be explained concretely.

Figure 1:
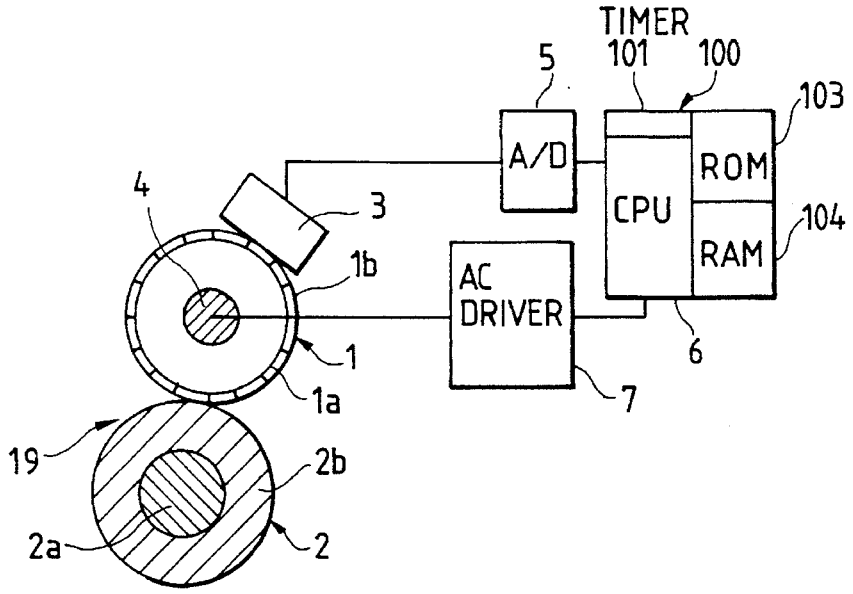
FIG. 1 is an elevational sectional view of a heat roller fixing device with illustrating a block diagram thereof.

In this embodiment, the present invention is applied to the heat roller fixing device used with a laser beam printer wherein the recording sheet P is fed at a speed of 50 mm/sec and eight sheets are outputted per minute. The fundamental construction of the heat roller fixing device is the same as that shown in FIG. 1 and the fixing device includes the heat roller 1 having a diameter of 25 mm and the pressure roller 2 having a diameter of 20 mm. The thickness of the metal core of the heat roller is 1.5 mm and the rated electric power of the halogen heater 4 is 500 W, so that, under the circumstance having the temperature of 25° C., it takes about 45 seconds to obtain the surface temperature of the heat roller permitting the recording after the printer is energized.

Next, the control method for the heat roller fixing device in the illustrated embodiment will be explained with reference to the flow chart shown in FIG. 2.

When the main power source 102 is turned ON to energize the printer, the CPU 6 immediately monitors the detection signal of the thermistor 3. In this case, when it is judged that the surface temperature of the heat roller 1 is lower than the minimum temperature which can be detected by the thermistor 3 ($T_0$=50° C.), the program then seeks the initial temperature $\theta_0$ of the heat roller at the initiation of energization. However, when the temperature $T_0$ exceeds 50° C., the initial temperature is not measured, but the temperature adjustment mode 2 is executed. In this example, the temperature adjustment mode 2 is so set that the surface temperature of the heat roller becomes 170° C. in the waiting condition of the printer and 180° C. in the printing condition. When the FS signal for turning ON the halogen heater 4 is emitted, the CPU 6 starts to count the internal timer 101.

Then, the time $t_1$ when the surface temperature $T_1$ of the heat roller 1 becomes 120° C. is sought, and then the time $t_2$ when the surface temperature $T_2$ becomes 140° C. is sought. The temperatures $T_1$ and $T_2$ are included within the linear line portion of the curve of the surface temperature of the heat roller and are set within the high temperature sensibility range of the detection circuit (FIG. 4) including the thermistor 3. Further, by measuring the temperatures and times at several points around $T_1$, $T_2$ and by averaging the measured data, the temperatures $T_1$, $T_2$ and times $t_1$, $t_2$ may be determined. In this case, more accurate result can be obtained. Incidentally, by further increasing the number of the measured points and by linear-approximating the obtained data, for example, by the method of least squares, high accurate linear approximate equation may be obtained.

From the data so obtained, the linear approximate equation T=at+b is obtained, and the inclination a and the armature b are determined. Then, by using the constants A, B of the correction expression predetermined experimentally, the obtained values a, b are inputted to the correction expression $\theta_0$=A·a+B+b, thus obtaining the initial temperature $\theta_0$ of the heat roller at the initiation of energization thereof. Although the constants A, B depend upon the response feature of the thermistor to be used and the mount method for the thermistor, they are almost determined by the mount condition of the thermistor. For example, when the thermistor element is mounted between a silicone sponge and a polyimide tape, the constant A has a value of 1–5, and the faster the response of the thermistor the smaller the value of the constant A. The constant B depends upon the rising of the halogen heater 4 and the heat amount escaped from the thermistor 3, and normally has a value of 1–5.

When the temperature $\theta_0$ so obtained is lower than the temperature adjustment mode switching temperature θc (=20° C.), the temperature adjustment mode 1 is executed; whereas, when $\theta_0$>θc, the temperature adjustment mode 2 is executed. Now, the temperature adjustment mode 1 controls the surface temperature of the heat roller 1 so that it becomes 185° C. in the waiting condition of the printer and 195° C. in the printing condition, and is changed to the temperature adjustment same as the temperature adjustment mode 2 after 20 minutes have been elapsed from the energization of the printer. In this way, since the temperature adjustment is set slightly higher when the atmospheric temperature is low and the initial temperature of the heat roller 1 at the initiation of energization thereof is low, it is possible to obtain the adequate fixing ability even if the temperature of the recording sheet P is low.

Further, the pressure roller 2 is cooled for a while from the initiation of energization. In this condition, the curling amount of the recording sheet P tends to be lesser, and thus, is substantially no problem even when the surface temperature of the heat roller 1 is high. Further, since the increase in temperature within the printer is stopped after 20 minutes from the initiation of energization of the printer, even when the surface temperature of the heat roller 1 is controlled with the high temperature, there is no problem. In the illustrated embodiment, since the heat capacity of the pressure roller 2 is low, the pressure roller is warmed up to about ⅓–½ of the saturation temperature of the pressure roller by about 20 minutes from the initiation of energization of the printer. It was found that even when the temperature adjust temperature was then lowered the fixing ability was well satisfactory.

Further, in the illustrated embodiment, the approximate linear line equation is calculated by using the linear line portion of the curve of the surface temperature of the heat roller 1, and the difference between the armature of that linear line and the actual initial temperature $\theta_0$ of the heat roller 1 is corrected by using the correction expression including the inclination of the linear line. Thus, if the rising time of the surface temperature of the heat roller 1 is long, the difference between the initial temperature $\theta_0$ and the armature of the approximate linear line becomes too great, thus increasing the error. In addition, since it is difficult to obtain the correct linear line portion of the curve of the surface temperature of the heat roller, the error at that portion will also be increased. It was found that when the curve of the surface temperature of the heat roller has an inclination greater than 1.5° C./sec (preferably, 2.0° C./sec) the accuracy could be well maintained.

As mentioned above, by setting the inclination of the curve of the surface temperature of the heat roller to have a value of 1.5° C./sec or more, it was found that the difference between the initial temperature $\theta_0$ of the heat roller 1 derived from the calculation in the illustrated embodiment and the actual initial temperature fell within a range of ±3° C.

Further, in the illustrated embodiment, since the approximate linear line of the curve of the surface temperature of the heat roller is calculated, the sufficient measuring accuracy can be obtained regardless of the dispersion in the rated electric power of the halogen heater 4 and/or the fluctuation of the input voltage.

Next, a second embodiment of the present invention will be explained.

Figure 5:
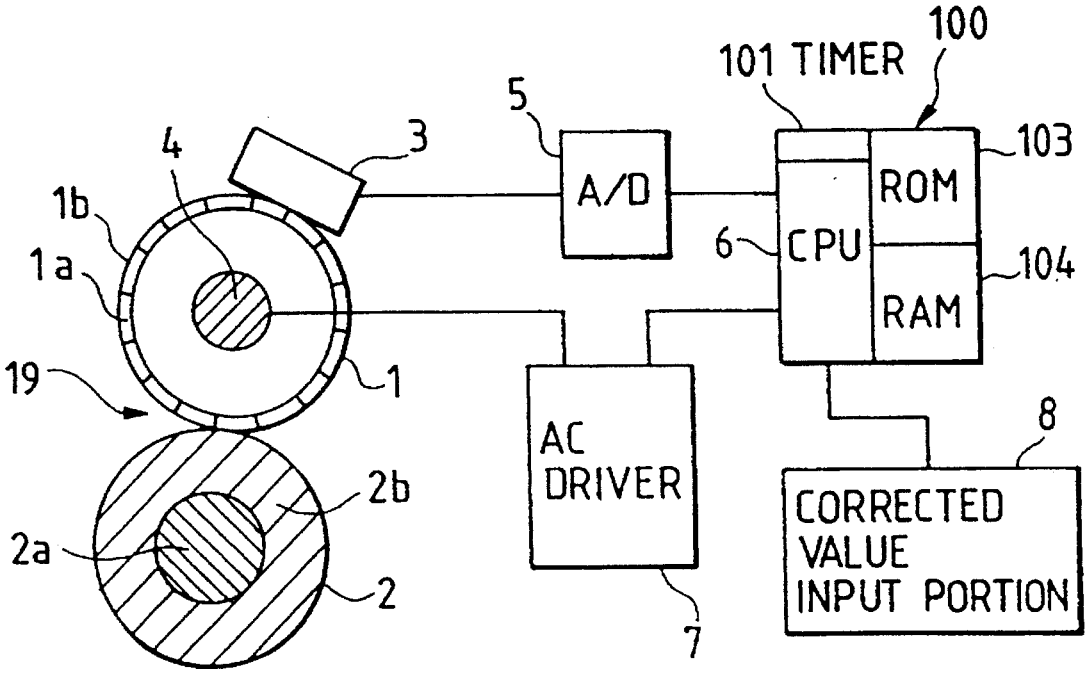
FIG. 5 is an elevational sectional view of a heat roller fixing device according to another embodiment of the present invention, with illustrating a block diagram thereof.

FIG. 5 is an elevational sectional view of a heat roller fixing device to which a second embodiment of the present invention is applied, with illustrating a control block diagram thereof.

According to the characteristic of this second embodiment, a corrected value input portion 8 is provided for correcting the dispersion in the temperature measurement of the thermistor 3. The corrected value can be inputted by previously seeking the temperature measuring error of respective thermistors 3 by measurement and by seeking the difference between the measured data and the output value of the typical thermistor within the temperature range where the data is inputted, or by seeking the curve of the surface temperature of the heat roller 1 by means of the thermistor incorporated into the heat roller fixing device and by seeking the difference between the output voltage of that thermistor and that of the typical thermistor, or by executing the algorism for seeking the initial temperature of the heat roller 1 at the initiation of energization thereof and by seeking the difference between the initial temperature and the actual initial temperature.

After the temperature measuring error of the thermistor 3 is so determined, the correction information is inputted to the CPU 6, for example, by using a dip switch and the like. The CPU 6 can eliminate the temperature measuring error of the thermistor 3 by rewriting the constant B (among the constants A, B in the correction expression) on the basis of the correction information.

Next, a third embodiment of the present invention will be explained.

FIG. 6 is a flow chart showing a third embodiment of the present invention.

Incidentally, in this flow chart, steps S1 to S10 are the same as those shown in FIG. 2, and thus, the explanation thereof will be omitted.

In this embodiment, the measured initial temperature $\theta_0$ of the heat roller 1 at the initiation of energization is compared with a selection temperature $\theta c_1$ for starting the simultaneous cooperating rotation (referred to as "forward multi-rotation" hereinafter) of the heat roller 1 and the pressure roller 2 to uniformly warm the surface temperature of the pressure roller during the warming-up of the apparatus following to the temperature adjustment switching temperature $\theta c$ (step S11).

If the temperature $\theta_0$ is higher than the temperature $\theta c_1$, it is judged that the pressure roller 2 is well warmed, and the temperature adjustment mode 1 is executed without performing the forward multi-rotation (step S12). To the contrary, if the temperature $\theta_0$ is lower than the temperature $\theta c_1$, it is judged that the pressure roller 2 is cooled, and a mode for performing the forward multi-rotation is effected to warm the pressure roller 2.

Then, it is monitored whether the surface temperature T of the heat roller 1 reaches a predetermined temperature $T_{10}$ (for example, 160° C.) (step S13); if the temperature T reaches the temperature $T_{10}$, the forward multi-rotation is started (step S14). Thereafter, the forward multi-rotation is finished when the warming-up period is expired, and the temperature adjustment mode 1 is effected (step S15).

In this way, according to this embodiment, the mode for performing the forward multi-rotation can be defined, and the forward multi-rotation is performed only as occasion demands. Thus, since the image forming apparatus can be set to the print permitting conidtion quickly, the waiting time can be reduced.

Incidentally, in this embodiment, it is preferable to set the temperature $\theta c_1$ smaller than the temperature $\theta c$ ($\theta c_1 < \theta c$).

Further, in addition to define the mode for performing the forward multi-rotation, the time period for the forward multi-rotation may be changed in accordance with the initial temperature $\theta_0$ of the heat roller 1. That is to say, when the initial temperature $\theta_0$ is high, the time period for the forward multi-rotation is shortened, whereas, when the initial temperature $\theta_0$ is low, the time period for the forward multi-rotation is lengthened. In this way, it is possible to reduce the waiting time until the printer becomes the print permitting condition.

In this way, according to this embodiment, it is possible to control the forward multi-rotation in accordance with the initial temperature of the heat roller 1.

While the present invention was explained in connection with specific embodiments thereof, the present invention is not limited to the heat roller fixing device, but may be applied to any fixing device utilizing a heat belt or film.

As mentioned above, according to the present invention, it is possible to change the temperature adjust temperature in accordance with the atmospheric temperature without providing the special temperature detecting means, and to suppress the curling amount of the recording sheet and the increase in temperature within the image forming apparatus to the minimum extent, while maintaining the sufficient fixing ability.

What is claimed is:

1. An image forming apparatus, comprising:

image forming means for forming an unfixed image on a recording medium;

a heating member for fixing the unfixed image;

a temperature detecting member for detecting a temperature of said heating member;

electric power supply controlling means for controlling power supply to said heating member so that the temperature of said heating member detected by said temperature detecting member is maintained at a fixing temperature during a fixing operation;

temperature change rate detection means for detecting a rate of change in temperature of said heating member; and fixing temperature changing means for changing the fixing temperature based on the rate of change in temperature detected by said temperature change rate detection means.

2. An image forming apparatus according to claim 1, wherein said image forming means includes an image bearing member bearing the unfixed image and transfer means for transferring the unfixed image on said image bearing member onto the recording medium.

3. An image forming apparatus according to claim 1, wherein said fixing temperature changing means determines the fixing temperature by processing a detected output of said temperature detecting member.

4. An image forming apparatus according to claim 3, wherein the processing is effected on a correcting formula predetermined in consideration of characteristics of said temperature detecting member.

5. An image forming apparatus according to claim 4, wherein, in said processing, plural detected outputs of said temperature detecting member are approximated to a linear line.

6. An image forming apparatus according to claim 5, wherein said fixing temperature changing means changes the fixing temperature higher when a value obtained by said processing is lower than a predetermined value.

7. An image forming apparatus according to claim 1, wherein said fixing temperature changing means changes the fixing temperature to lower value after predetermined time lapse when a higher fixing temperature is set.

8. An image forming apparatus according to claim 1, wherein said apparatus has a main power source, and said electric power supply to said heating member starts by activation of said main power source.

9. An image forming apparatus according to claim 1, wherein said heating member is a heating roller nipping and conveying the recording medium.

10. An apparatus according to claim 1, wherein the rate of change in temperature is determined on the basis of a time at which the temperature of said heating member reaches a first temperature and a time at which the temperature of said heating member reaches a second temperature.

11. An apparatus according to claim 10, further comprising measuring means for measuring an elapsed time from starting of energizing power supply to said heating member.

12. An apparatus according to claim 10, wherein the second temperature is higher than the first temperature.

13. An apparatus according to claim 1, wherein the rate of change in temperature is determined on the basis of the temperature of said heating member at a first predetermined time and a second predetermined time later than the first predetermined time.

14. An apparatus according to claim 13, wherein the first predetermined time is a time after a predetermined elapsed time from starting of energizing power supply to said heating member.

15. An apparatus according to claim 1, wherein said temperature change rate detection means detects the rate of change in temperature of said heating member during a warm-up period.

* * * * *

UNITED STATES PATENT AND TRADEMARK OFFICE

CERTIFICATE OF CORRECTION

PATENT NO. : 5,572,306

DATED : November 5, 1996

INVENTOR(S) : Goto et al.

It is certified that error appears in the above-indentified patent and that said Letters Patent is hereby corrected as shown below:

COLUMN 1

Line 21, change "a" to --the--;
Line 22, change "the" to --a--;
Line 31, change "Among" to --Between--;
Line 54, change "upon" to --by--.

COLUMN 4

Line 4, before "separated" insert --is--.

COLUMN 6

Line 48, change "are" to --is--.

COLUMN 8

Line 57, delete "well".

COLUMN 9

Line 39, change "algorism" to --algorithm--;
Line 64, delete "to".

Signed and Sealed this

Twenty-second Day of April, 1997

Bruce Lehman

*Attest:*

BRUCE LEHMAN

*Commissioner of Patents and Trademarks*

*Attesting Officer*